US007165616B2

(12) United States Patent
Jørgensen

(10) Patent No.: US 7,165,616 B2
(45) Date of Patent: Jan. 23, 2007

(54) METHOD OF CONTROLLING THE DIRECTION OF PROPAGATION OF INJECTION FRACTURES IN PERMEABLE FORMATIONS

(75) Inventor: Ole Jørgensen, Virum (DK)

(73) Assignee: Maersk Olie OG Gas A/S, Copenhagen (DK)

( * ) Notice: Subject to any disclaimer, the term of this patent is extended or adjusted under 35 U.S.C. 154(b) by 92 days.

(21) Appl. No.: 10/478,250

(22) PCT Filed: May 21, 2002

(86) PCT No.: PCT/DK02/00333

§ 371 (c)(1),
(2), (4) Date: Apr. 29, 2004

(87) PCT Pub. No.: WO02/095188

PCT Pub. Date: Nov. 28, 2002

(65) Prior Publication Data

US 2004/0177955 A1 Sep. 16, 2004

(30) Foreign Application Priority Data

May 22, 2001 (DK) ..... PA 2001 00826

(51) Int. Cl.
*E21B 43/26* (2006.01)
*E21B 47/10* (2006.01)

(52) U.S. Cl. ..... 166/308.1; 166/250.1; 166/52

(58) Field of Classification Search ..... 166/250.1, 166/308.1, 52
See application file for complete search history.

(56) References Cited

U.S. PATENT DOCUMENTS 4,724,905 A 2/1988 Uhri (Continued)

FOREIGN PATENT DOCUMENTS

DE 3120479.1-24 5/1982

(Continued)

*Primary Examiner*—William Neuder
*Assistant Examiner*—Shane Bomar
(74) *Attorney, Agent, or Firm*—Ladas & Parry

(57) ABSTRACT

The invention relates to a method of controlling the production of oil or gas from a formation (1) comprising that a first and second drilled production well (105, 110) are formed next to each other that extend essentially horizontally, that, at the drilled production wells, a further drilled well (115) is formed that extends between the first and the second drilled production well (105, 110), that the production of oil or gas is initiated, and that, while oil or gas is being produced, a liquid is conveyed to said further drilled well (115) and out into the formation (1) for a first period of time $T_1$. The invention is characterised in that the pore pressure of the formation is influenced during the period $T_1$ with the object of subsequently controlling the formation of fractures along a drilled well, typically across large distances in the reservoir. Such influence is accomplished partly by production in adjacent wells, partly by injection at low rate without fracturing in the well in which the fracture is to originate. Injection at low rate presupposes that an at least approximated determination is performed of the maximally allowable injection rate $I_{max}$ for the period $T_1$ in order to avoid fracturing ruptures in said further drilled well (115) when liquid is supplied by the injection rate I for the liquid supplied to the further drilled well being kept below said maximally allowable injection rate $I_{max}$ for said first period of time $T_1$ when the relation $\sigma'_{hole,min} <= \sigma'_h$ has been complied with.

7 Claims, 7 Drawing Sheets

U.S. PATENT DOCUMENTS

| | | | | | |
|---|---|---|---|---|---|
| 4,793,413 | A | * | 12/1988 | Singh et al. | 166/250.1 |
| 5,133,410 | A | * | 7/1992 | Gadelle et al. | 166/308.1 |
| 5,236,040 | A | * | 8/1993 | Venditto et al. | 166/250.1 |
| 5,482,116 | A | | 1/1996 | El-Rabaa et al. | |
| 5,497,831 | A | * | 3/1996 | Hainey et al. | 166/308.1 |
| 5,511,615 | A | * | 4/1996 | Rhett | 166/250.1 |
| 5,894,888 | A | * | 4/1999 | Wiemers et al. | 166/250.1 |
| 6,002,063 | A | * | 12/1999 | Bilak et al. | 588/17 |
| 6,443,227 | B1 | * | 9/2002 | Hocking et al. | 166/250.1 |
| 6,769,486 | B1 | * | 8/2004 | Lim et al. | 166/263 |

FOREIGN PATENT DOCUMENTS

| | | |
|---|---|---|
| EP | 0474350 | 3/1992 |
| EP | 0602980 | 6/1994 |

* cited by examiner

METHOD OF CONTROLLING THE DIRECTION OF PROPAGATION OF INJECTION FRACTURES IN PERMEABLE FORMATIONS

FIELD OF THE INVENTION

The present invention relates to an improved method of the general kind wherein, for the production of oil or gas from a formation, a first and a second drilled production well are formed next to each other, and wherein a further drilled well, a so-called injection well, is established that extends at and between the first and the second drilled well, wherein—while oil or gas is being produced—a liquid is conveyed to the drilled injection well and out into the formation for a period of time $T_1$.

BACKGROUND

The invention is based on the fact that, during supply of liquid to a drilled injection well at high injection rates, fractures may occur that propagate from the drilled injection well through those areas of the formation that have inherent weaknesses and/or in the direction of the maximal horizontal stress $\sigma'_H$ of the formation. These fractures are undesirable in case they mean that liquid flows away uncontrollably from the drilled injection well directly into either the first or the second adjoining drilled production well, which would mean that the operating conditions are not optimal. However, in general the formation of fractures has the advantage that the supplied liquid can more quickly be conveyed into the surrounding formation across a larger vertical face and is thus able to more rapidly displace the contents of oil or gas.

SUMMARY OF THE INVENTION

By the invention it is attempted to provide a very particular fracture that extends from a drilled injection well in order to optimise the production of oil or gas. More specifically the present invention aims to enable control of the propagation of such fracture in such a manner that the fracture has a controlled course and will to a wide extent extend in a vertical plane along with and coinciding with the drilled injection well.

This is obtained by performing, in connection with the method described above, at least an approximated determination of the maximally allowable injection rate $I_{max}$ during the period $T_1$ to avoid fracturing in the drilled injection well when liquid is supplied, in that the injection rate I for the liquid supplied to the drilled injection well is kept below said maximally allowable injection rate $I_{max}$ for said first period of time $T_1$, and in that the injection rate I is increased to a value above $I_{max}$ following expiry of the period of time $T_1$ when the relation $\sigma'_{hole,min} <= \sigma'_h$ has been complied with. The term 'injection rate' as used herein in this context is intended to designate the amount of liquid, expressed as amount per time unit, supplied to the drilled injection well.

U.S. Pat. No. 5,482,116 teaches a method of controlling the direction of a hydraulic fracture induced from a wellbore. The method does not make use of induced changes to the stress field by production and injection before fracturing.

In the present invention, the maximally allowable injection rate $I_{max}$ for avoiding fracturing may eg be determined or estimated by the so-called 'step rate' test, wherein the injection rate is increased in steps while simultaneously the pressure prevailing in the well bore is monitored. When the curve that reflects this relation suddenly changes its slope, such change is—in accordance with current theories—construed as on-set of fracture, propagation, and the injection rate I that produces such fracture formation is, in the following, designated $I_{max}$.

It is preferred that the drilled wells are established so as to extend essentially horizontally, whereby the vertical stresses of the formation contribute further to the invention. The term 'essentially horizontally' as used in this context is intended to designate well bores that extend within an angle range of +/−about 25° relative to the horizontal plane. It is noted that the invention may also be practised outside this range.

It is further preferred that, prior to establishment of the well bores, the direction of the largest effective inherent principal stress $\sigma'_H$ of the formation in the area of the planned location of the well bores is estimated, and that the drilled wells extend within the interval +/−about 25° relative to this direction.

DETAILED DESCRIPTION

Figure 1:
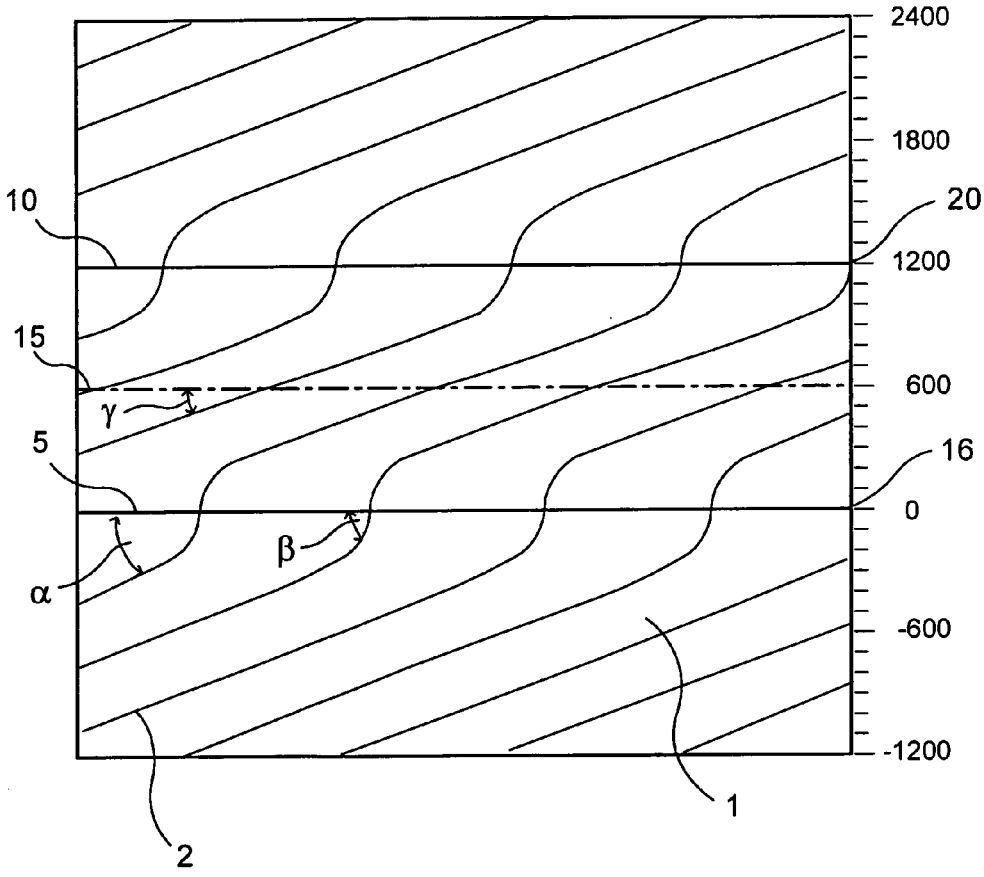
F I G. 1 PRIOR ART
FIG. 1 shows two drilled production wells, from which oil or gas is produced, and the orientation of the principal stresses in the surrounding formation.

In FIG. 1 reference numerals 5, 10 designate two drilled production wells for the production of oil or gas from a Cretaceous formation 1. The drilled production wells 5, 10 extend in an approximately shared plane in the formation 1 at a depth of eg about 7000 ft below sea level. The shown shared plane is horizontal, but it may have any orientation. For instance, the drilled production wells 5, 10 may extend in a plane with a slope comprised within the interval +/−about 25° relative to the horizontal plane.

In a conventional manner the drilled production wells 5, 10 are, via upwardly oriented well bores in the areas 16, 20, connected to a well head, from where oil or gas from the formation 1 is supplied to a distribution system on the surface. The well bores 5, 10, 16, 20 are established, as is usually the case, by drilling from the surface.

The drilled production wells 5, 10 may have a longitudinal expanse of eg about 10,000 ft and preferably extend mutually in parallel, eg at a distance of about 1200 ft. The drilled production wells 5, 10 may, however, within the scope of the invention, diverge slightly in a direction from the areas 16, 20. The situation shown in FIG. 1 is representative of an authentically occurring course of drilling, the scale shown describing distances in ft.

The invention aims at providing, in the formation, a stress field that ensures that a fracture generated by injection at sufficiently elevated pressure and rate extends along the well at which the fracture is initiated The invention presupposes knowledge of the initial state of stresses of the formation, ie the state of stresses prior to the up-start of any substantial production or injection. In many cases the stress field in the formation will initially be oriented such that the principal stresses are constituted by two horizontal stress components and by one vertical stress component. In such cases, determination of the initial effective stress field requires determination of four parameters: $\sigma'_v$ that is the vertical effective stress component, $\sigma'_H$ that is the maximal horizontal effective stress component, and $\sigma'_h$ that is the horizontal effective stress component perpendicular to $\sigma'_H$, and the direction of $\sigma'_H$. The value of $\sigma'_V$ is given by the weight of the overlaying formation minus the pressure, p, of the pore fluid. The pressure p of the pore fluid can be measured from the wall of a drilled well by means of standard equipment. The weight of the overlaying formation can be determined eg by drilling through it, calculating the density of the formation along the drilled well on the basis of measurements taken along the drilled well, and finally determining the total weight per area unit by summation. In cases when $\sigma'_V$ is the larger of the three principal stresses, the determination of $\sigma'_h$ can be performed eg by hydraulic fracture formation—more specifically by measuring the stress at which a hydraulically generated fracture doses. Determination of $\sigma'_H$ can, in cases when $\sigma'_V+\xi(3\sigma'_h-\sigma'_H)>3\sigma'_h-\sigma'_H$, where $\xi$ express for the formation, for instance be performed by fracturing a vertical drilled well, where the fracturing pressure will be a function of $(\sigma'_H-\sigma'_h)$ and of $\sigma'_h$. In cases when $\sigma'_v$ is the larger of the three principal stresses, the direction of $\sigma'_H$ can be determined by measuring the orientation of a hydraulically generated fracture that will, provided the formation has isotropic strength properties, extend in a vertical plane coincident with $\sigma'_H$. Prior knowledge of the value of $\sigma'_H$ is not essential if the invention is used to fracture wells in a well pattern that follows the direction of $\sigma'_H$, as is preferred.

When production is performed in the field, liquids and/or gasses that flow in the formation will change the state of stresses of the formation. For use in a continuous determination of the state of stresses in the reservoir, in addition to knowledge of the initial state of stresses, use may be made of a model calculation of the flow within the reservoir as well as a model calculation of the resulting effective stresses in the reservoir rock. Flow simulation can be performed by standard simulation software with measurements of production and injection rates and pressures from the wells as input. From the calculated stress field, the pressure gradient field can be derived which determines the volume forces by which the solid formation is influenced in accordance with the following formula:

$$b_x=-\beta dp/dx;\ b_y=-\beta dp/dy;\ b_z=-\beta dp/dz \qquad 1)$$

wherein p is the pore pressure within the formation, while $\beta$ is the Biot-factor of the formation and x, y and z are axes in a Carthesian system of co-ordinates. The effect of these volume forces on the effective stress field in the formation will follow from the elasticity theory and may be calculated eg by the method of finite elements.

By the reference numeral 2, FIG. 1 shows the course of the principal stress component $\sigma'_H$ in the formation 1 in the shown plane following a production period of six months. As seen, the orientation $\alpha$ of the effective principal stress $\sigma'_H$ relative to the drilled production wells 5, 10 is relatively unaffected by the production a certain distance from the production wells 5, 10. In the example, the angle $\alpha$ constitutes about 25°. The designation $\gamma$ further designates the orientation of $\sigma'_H$ relative to a line indicated by the numeral 15 that extends centrally between the drilled production wells 5, 10. As seen, the angle $\gamma$ corresponds approximately to the angle $\alpha$ in the example shown.

It will also appear that the principal stress component $\sigma'_H$ immediately at the drilled production wells 5, 10 has a modified orientation, the principal stress being oriented approximately perpendicular to the drilled production wells 5, 10, ie at an angle less than the angle $\beta$. In other words, the compressive stresses in the formation will, in this area, have a maximal component that is oriented approximately perpendicular towards the drilled production wells 5, 10. This change of direction is initiated upon onset of production and is due to the inflow in the drilled production wells 5, 10 of the surrounding fluids.

Figure 2:
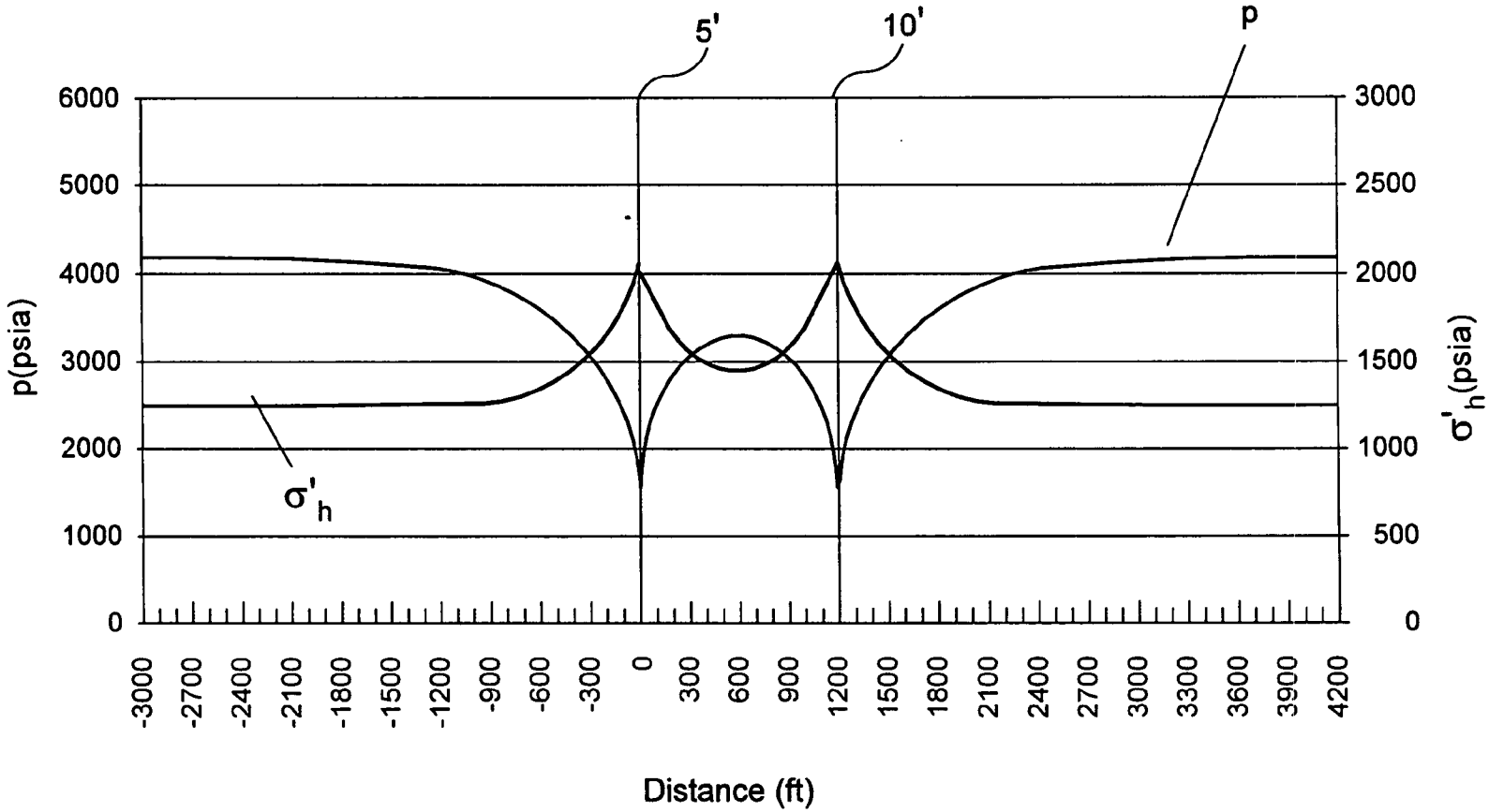
FIG. 2 PRIOR ART
FIG. 2 shows the stresses in the formation shown in FIG. 1 following six months of production.

FIG. 2 shows the development of the stresses $\sigma'_h$ and the pore pressure p in a cross sectional view through the formation in the situation shown in FIG. 1 following a production period of six months, the lines 5', 10' indicating longitudinally extending vertical planes that contain the drilled production wells 5, 10.

Figure 3:
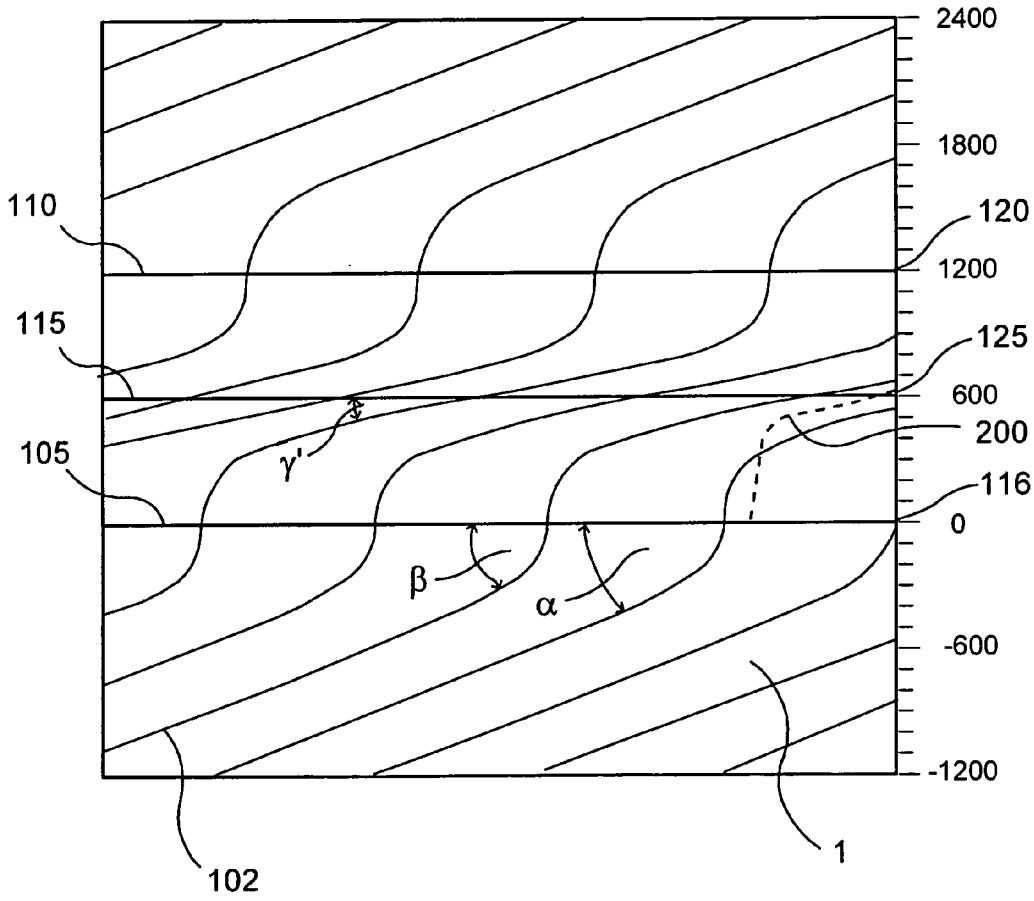
FIG. 3 shows two drilled production wells, from which oil or gas is produced, and a drilled injection well to which liquid is supplied, and the orientation of the principal stresses in the surrounding formation.

FIG. 3 shows how the method according to the invention can be exercised with the object of providing improved operating conditions from the production wells shown in FIG. 1 that will, in the following, be designated by the reference numerals 105, 110. The shown conditions correspond to the teachings shown with reference to FIG. 1 inasmuch as the locations of the drilled production wells 105, 110 are concerned.

It will appear that, along a line corresponding to the line 15 of FIG. 1, a further drilled well is produced that extends, in an area 125, from the formation to the surface where it is connected to a pump for the supply of liquid, preferably sea water, to the drilled well section 115. The further drilled well section 115 will, in the following, be designated the 'drilled injection well'.

Preferably the drilled injection well 115 has the same length as the drilled production wells 105, 110 and will typically be unlined, meaning that the wall of the drilled well is constituted by the porous material of the formation 1 as such. However, the drilled well 115 can also be lined.

Besides, FIG. 3 shows—by means of the curve family 102—the stress relations in the formation 1 six months following the onset of production. The stress relations reflect that, for a period of time $T_1$ corresponding to the immediately preceding three months, liquid has been supplied, preferably sea water or formation water, to the formation 1 via the drilled injection well 115 and under particular pressure conditions that will be subject to a more detailed discussion below.

The supply of liquid to the porous formation generally involves—as well known—that the contents of oil or gas in the formation 1 between the drilled production wells 105, 110 are, so to speak, displaced laterally towards the drilled production wells 105, 110, whereby the fluids initially in place are produced more quickly. By the invention the supplied liquid can be caused to give rise to further changes in the state of stresses along the drilled injection well. As shown in FIG. 3, this can be verified by the angle γ' between the line defined by the drilled injection well 115 and the principal stress direction $\sigma'_H$ being less than the corresponding angle γ for the conditions without supply of liquid by the method according to the invention, see FIG. 1. This change is detected in the area along the entire drilled injection well. The fact that the orientation of $\sigma'_H$ in the vicinity of the injection well is oriented approximately in parallel with the drilled injection well 115 contributes—as will be explained in further detail below—positively to achieving the effect intended by the invention. If, as is the case of a preferred embodiment of the invention, it is selected to form the drilled production wells 105, 110 and the drilled injection well 115 such that, to the widest extent possible, they follow the orientation 102 of the natural effective principal stress $\sigma'_H$ of the formation, it is possible to provide, at a very early stage following the onset of liquid supply, advantageous conditions for achieving the effect intended with the invention.

Figure 4:
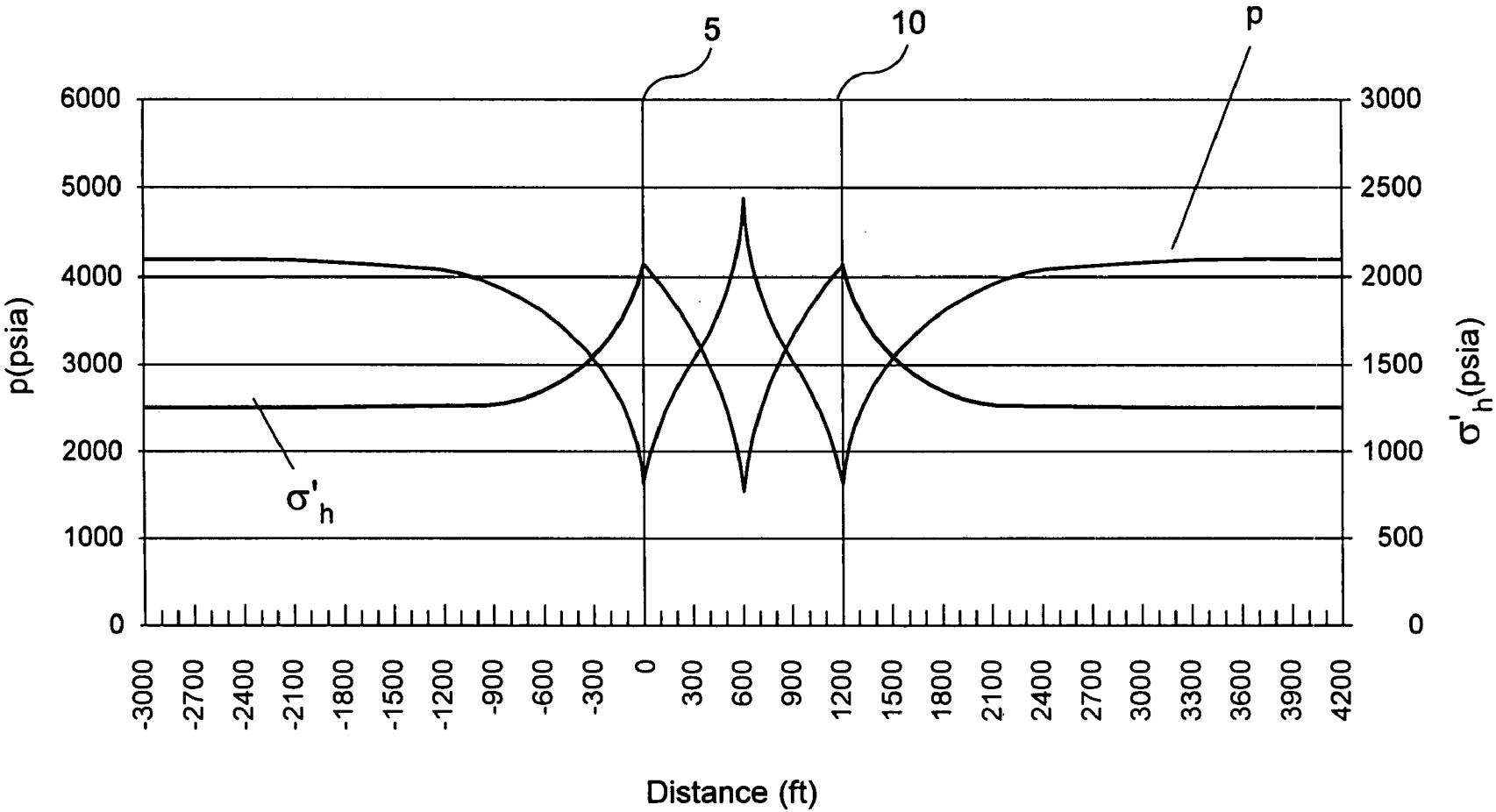
FIG. 4 shows the stresses in the formation shown in FIG. 3 following six months of production and three months of water injection.

As will appear from FIG. 4, which illustrates the state of stresses in the formation 1 in the situation shown in FIG. 3, the value $\sigma'_h$ in the area at the drilled injection well 115 will, as a consequence of the supplied liquid, be less than the corresponding value shown in FIG. 2.

As mentioned initially, the invention is based on the finding that, during the supply of liquid to a drilled injection well at elevated injection rates, undesirable fractures may occur that propagate from the drilled injection well and into one of the adjoining drilled production wells. Study of FIG. 3 will reveal such randomly extending fracture as outlined by the reference numeral 200. The shown fracture extends vertically out of the plane of the paper, but the fracture may—depending on conditions prevailing in the formation 1—extend in any other direction.

By the invention it is aimed to benefit from the advantages that are associated with a fracture that extends out of a drilled injection well. Study of FIG. 3 will show that by the invention it is, to a large extent, possible to provide an advantageous fracture in the form of a widely vertical slot that extends along and coincides with the drilled injection well 115.

In order to obtain the intended effect in accordance with the invention, liquid is initially supplied, while production is being carried out to the drilled injection well 115 at a relatively low injection rate I. This state is maintained as a minimum for a period $T_1$ which will, as mentioned, cause the stress field to be reoriented around the drilled injection well, whereby the numerically smallest normal stress component $\sigma'_h$ is oriented approximately perpendicular to the course of the drilled injection well 115. In other words the smallest stress that keeps the formation under compression is oriented towards the plane in which it is desired to achieve the fracture. The liquid pressure P in the drilled injection well 115 should, during the period $T_1$, be smaller than or equal to the pressure $P_f$, the fracturing pressure, that causes tension failure in the formation, and the injection rate I shall, during the period $T_1$, be smaller than or equal to the injection rate $I_{max}$ that gives rise to tension failures in the formation.

Due to the supply of liquid to the drilled injection well 115, local stress changes will occur in the formation along the periphery of the drilled injection well, and the invention makes use of this notch effect at the drilled well 115.

Above it was described how the flow of fluids changes the stress field in the reservoir. The resulting stress field can be calculated by adding the stress changes to the initial state of stresses. In particular, the stresses can be evaluated along a line in the reservoir, position 115, along which an injector well has been drilled.

In the above the local variation of the stress field around the wells—caused by the occurrence of a hole in the formation—is not included. Within a radius from the drilled well of about three times the radius of the hole, the stress field will depend on the stress field evaluated along the line through the reservoir that the drilled well follows, but will differ significantly therefrom. The stresses on the surface of the well bore as such are of particular interest to the invention, in particular the smallest effective compressive stress—or the largest tensile stress in case an actual state of tension occurs at the hole wall. Such stress is in the following designated $\sigma'_{hole,min}$. In cases where $\sigma'_{hole,min}$ is a tensile stress, it is counted to be negative, whereas compressive stresses are always counted to be positive. Calculation of $\sigma'_{hole,min}$ presupposes in the following that deformations in the formation are linearly elastic. Given this condition, $\sigma'_{hole,min}$ can be calculated by a person skilled in the art along a well track with any random orientation relative to any random—but known—state of stresses.

In cases where a horizontal unlined injector is essentially parallel with $\sigma'_H$ (note that production and injection may cause this parallelism, where it does not apply immediately at the time of drilling of the injector as indicated in FIG. 3), and where $\sigma'_V$, $\sigma'_H$, $\sigma'_h$ are principal stresses calculated along the line in the reservoir where the well is drilled, and it further applies that $\sigma'_V > \sigma'_H > \sigma'_h$, $\sigma'_{hole,min}$ is to be found on the top and bottom faces of the hole and is given by the expression:

$$\sigma'_{hole,min} = 3\sigma'_h - \sigma'_V \qquad 2)$$

wherein $\sigma'_h$ and $\sigma'_v$ are, in the present context, an expression of the effective stresses in the formation in the area of the position of the drilled injection well 115 determined on the basis of the elasticity theory with due regard to the ingoing flows, cf. formula 1).

Figure 5A:
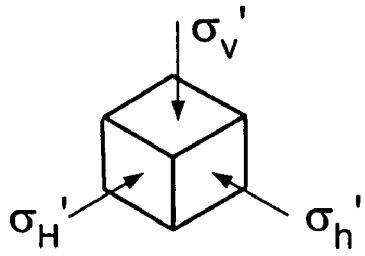
FIG. 5A shows the principal stresses acting on a unit element around the drilled injection well.
Figure 5B:
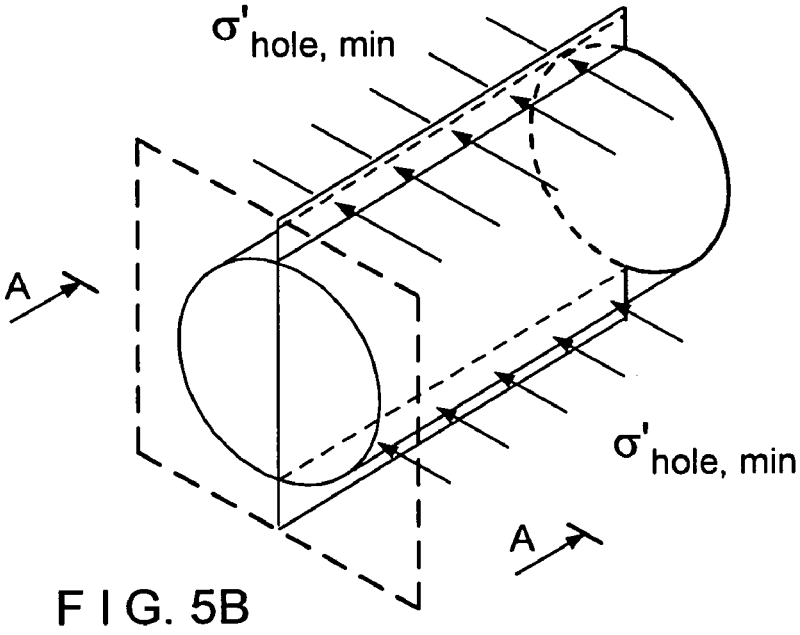
FIG. 5B diagrammatically shows the minimum state of stress around the well.
Figure 5C:
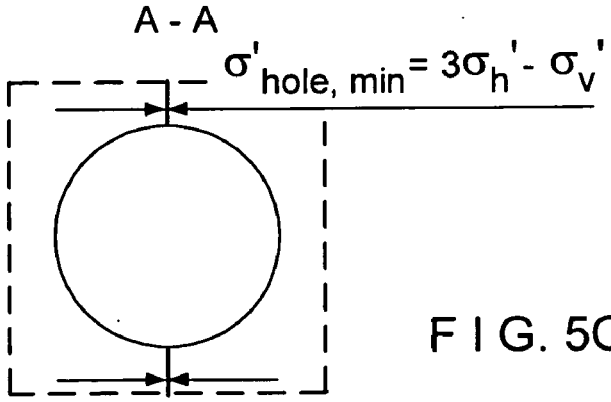
FIG. 5C is a section taken on line A—A in FIG. 5B indicating minimum hole stress.

Also, in these cases around the drilled horizontal well, $\sigma_{hole,min}$ is found along the upper and lower parts of the drilled well, ie in two regions that are in a horizontal plane as illustrated in FIG. 5. If the drilled well 115 is circular, these areas are located where the vertical diameter of the circle intersects the circle.

Since the liquid flow, as mentioned, gives rise to $\sigma'_h$ decreasing over time, $\sigma'_{hole,min}$ will decrease. It will appear from formula 2) that $\sigma'_{hole,min}$, $_{min}$ decreases when $\sigma'_v$ increases. The production from the drilled production wells 105, 110 gives rise to such increase of $\sigma'_v$.

In order to provide the desired fracture, the injection rate is increased, as mentioned, after a certain period of time $T_1$ has elapsed since the onset of the injection.

The condition that must be complied with to enable an increase in the injection rate—and a controlled fracturing of the formation—is in all cases that the relation $$\sigma'_{hole,min} < \sigma'_h \qquad 3)$$

has been complied with along the part of the well that is used for steering the propagation of the fracture.

Provided the injection rate is increased prior to this condition being complied with, ie before expiry of the requisite period of time $T_1$, there will be an increased risk of undesired fractures as described above.

Figure 6:
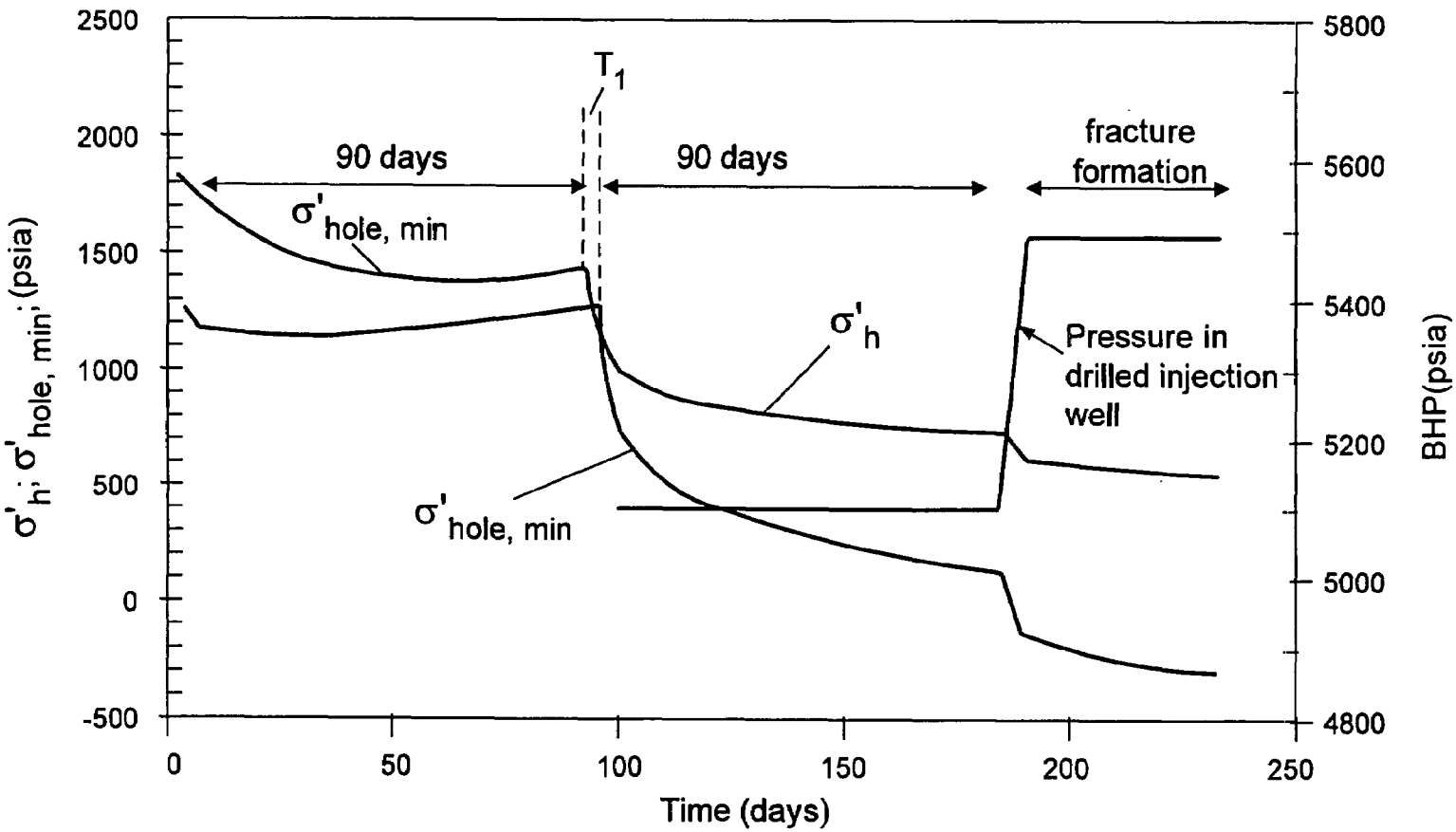
FIG. 6 shows the development, over time, of the stresses immediately above the drilled injection well shown in FIG. 5.

The described course of events is illustrated in FIG. 6 that shows how the injection of liquid is initiated about 90 days following onset of production. At a point in time $T_1$ after onset of injection the above relation 3) has been complied with. In the example injection is performed at the injection rate I for further 90 days, at which point in time $\sigma'_H$ has advantageously undergone a considerable change of orientation ($\gamma-\gamma'$) of about 15°. Then the injection rate is increased to a value above $I_{max}$, which is illustrated in FIG. 6 by the pressure in the drilled injection well increasing. It will appear that $\sigma'_{hole,min}$ abruptly changes character from compressive stress to tensile stress, whereby the tensile strength of the formation is reached, and fracturing results.

It is noted that, in case the injection rate is not increased, according to the theory of the applicant, it is also possible to obtain, in the case shown, the desired fracture when $\sigma'_{hole,min}$, after a given period, reaches the value of the tensile strength of the formation. However, in many cases this will cause substantial delays.

Figure 7:
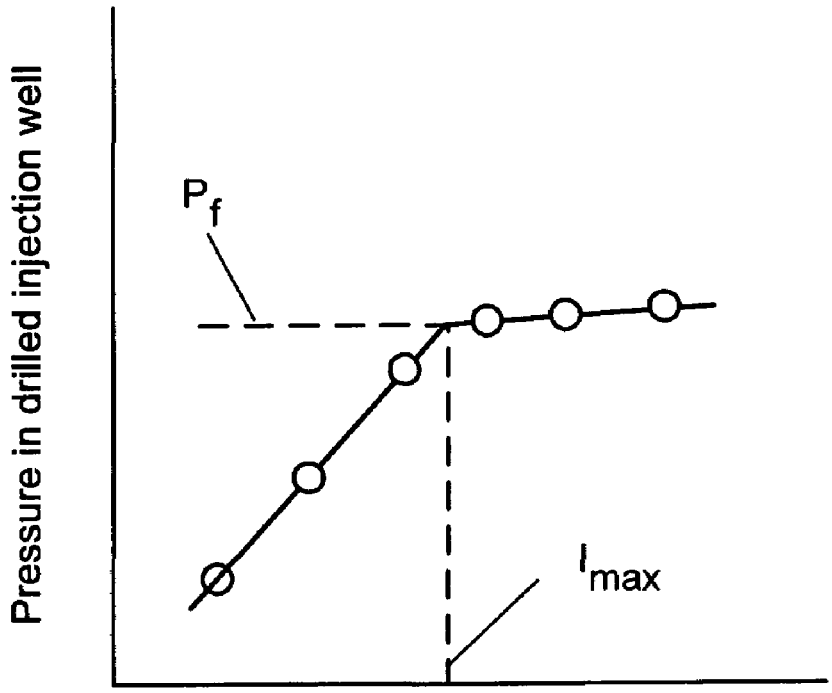
FIG. 7 illustrates a typical relation between the pressure in the injection well and the injection rate.

In FIG. 7 a typical measurement result is provided by the so-called 'step rate' test for determining the maximally allowable injection rate $I_{max}$. It is noted that in certain cases, it may be relevant to perform a continuous determination of the maximally allowable injection rate $I_{max}$. This is due to the fact that $I_{max}$ may vary over time. Thus, during the period of time $T_1$ it may prove necessary to reduce the injection rate I.

The invention claimed is:

1. A method of controlling the direction of propagation of injection fractures in a permeable formation (1), from which oil and/or gas is produced, comprising:

drilling in the formation (1), first and second drilled production wells (105, 110) next to each other;

drilling at the drilled production wells (105, 110), a further drilled well (115) that extends between the first and the second drilled production wells (105, 110);

initiating production of oil and/or gas;

while oil or gas is being produced, conveying a liquid to said further drilled well (115) and out into the formation (1) for a first period of time $T_1$;

performing at least an approximated determination of the maximally allowable injection rate $I_{max}$ for the period $T_1$ in order to avoid producing fracturing ruptures in said further drilled well (115) when liquid is supplied therein;

keeping the injection rate I for the liquid supplied to the further drilled well (115) below said maximally allowable injection rate $I_{max}$ for said time period $T_1$; and increasing the injection rate I to a value above $I_{max}$ after expiry of the period of time $T_1$ when the relation $\sigma'_{hole,min} <= \sigma'_h$ has been complied with along the further drilled well (115), wherein $\sigma'_h$ is the minimum horizontal effective stress component and $\sigma'_{hole,min}$ is the minimum effective compressive circumferential stress at the wall of the further drilled well (115).

2. A method according to claim 1, comprising establishing the drilled wells (105,110,115) so as to have an essentially horizontal expanse.

3. A method according to claim 1, comprising estimating prior to establishment of the drilled wells (105, 110, 115) the direction (102) of the initial effective principal stress $\sigma'_h$ of the formation in the area of the planned location of the drilled wells, and the drilled wells (105, 110, 115) are formed so as to extend at an angle within +/−25° relative to this direction.

4. A method according to claim 1, comprising placing the further drilled well (115) approximately equidistantly between the first and the second drilled wells (105, 110).

5. A method according to claim 1, comprising providing the further drilled well (115) with a lining prior to the supply of liquid.

6. A method according to claim 1, comprising prior to said liquid being conveyed to the further drilled well (115), stimulating the further drilled well with a view to increasing the spreading of liquid in the formation.

7. A method according to claim 6 wherein the further drilled well is stimulated, prior to liquid being supplied thereto, by adding acid into the further drilled well.

* * * * *